US009199113B1

(12) United States Patent
Hardy

(10) Patent No.: US 9,199,113 B1
(45) Date of Patent: Dec. 1, 2015

(54) YOGA PROP AND METHOD OF USE

(71) Applicant: Kristina M Hardy, Monrovia, CA (US)

(72) Inventor: Kristina M Hardy, Monrovia, CA (US)

( * ) Notice: Subject to any disclaimer, the term of this patent is extended or adjusted under 35 U.S.C. 154(b) by 0 days.

(21) Appl. No.: 14/336,592

(22) Filed: Jul. 21, 2014

(51) Int. Cl.
*A63B 22/00* (2006.01)
*A63B 21/002* (2006.01)

(52) U.S. Cl.
CPC ..... *A63B 21/0023* (2013.01)

(58) Field of Classification Search
USPC ..... 482/1–148
See application file for complete search history.

(56) References Cited

U.S. PATENT DOCUMENTS

| | | | | |
|---|---|---|---|---|
| 7,628,740 | B2 * | 12/2009 | Harrington | 482/121 |
| 2003/0199375 | A1 * | 10/2003 | Edwards | 482/148 |
| 2006/0216493 | A1 * | 9/2006 | Li | 428/317.9 |
| 2009/0062093 | A1 * | 3/2009 | Clark | 482/148 |
| 2010/0240508 | A1 * | 9/2010 | Guarrasi | 482/142 |
| 2012/0295777 | A1 * | 11/2012 | Zaki | 482/122 |
| 2012/0329623 | A1 * | 12/2012 | Ramirez | 482/139 |

* cited by examiner

*Primary Examiner* — Stephen Crow
(74) *Attorney, Agent, or Firm* — Eric Karich; Karich & Associates

(57) ABSTRACT

A yoga prop has a rigid elongate plate and end walls extending from the ends of the plate. The yoga prop is used in various methods to perform various yoga postures. The elongate plate has two ends, and has a preselected length. The end wall extending outwardly from each of the two ends of the elongate plate generally perpendicular to the elongate plate. A resilient coating covering substantially all of the elongate plate and the end walls.

2 Claims, 3 Drawing Sheets

YOGA PROP AND METHOD OF USE

BACKGROUND OF THE INVENTION

1. Field of the Invention

This invention relates generally to yoga props, and more particularly to a yoga prop that helps hold a practitioner's limbs in a correctly spaced position, and which may be used for stretching.

2. Description of Related Art

A yoga practitioner must assume different postures for performing different yoga exercises. Since yoga exercises can be difficult to perform correctly, the practitioner who is going to start a yoga program may encounter many difficulties. It has therefore become common to use various tools, known as "props," to facilitate various exercises, and to assist practitioners in performing various exercises and in achieving more correct postures.

Conventional yoga props include blocks, rigid wedges or slants, bolsters, folded blankets and rolled up mats. Yoga blocks and bricks, currently available on the market, are blocks of hardwood or foam generally about 3"×5"×9". These blocks provide some benefit in support for some positions and allow more comfortable wrist/hand/finger orientations for some positions. For example, current yoga blocks allow the practitioner to reduce the reach to the floor in some positions and to curl the fingers in other positions.

There is currently no tool or prop, however, that assists a practitioner in achieving a correct posture, and assisting a practitioner with improving and maintaining the posture. It is desirable to have props that accommodates the practitioner's experience, physical limitations, and other individual needs, allowing the practitioner to comfortably and correctly maintain yoga postures. Such a prop should be ergonomically designed in size and shape, and fabricated from materials to provide tactile comfort.

The prior art teaches various yoga props. However, the prior art does not teach a prop that assists a practitioner in achieving a correct posture, and assisting a practitioner with improving and maintaining the posture. The present invention fulfills these needs and provides further advantages as described in the following summary.

SUMMARY OF THE INVENTION

The present invention teaches certain benefits in construction and use which give rise to the objectives described below.

The present invention provides a yoga prop and various methods of using the yoga prop to perform various yoga postures. The yoga prop has a rigid elongate plate with two ends, the elongate plate having a preselected length; an end wall extending outwardly from each of the ends of the elongate plate generally perpendicular to the elongate plate; and a resilient coating covering substantially all of the elongate plate and the end walls.

A primary objective of the present invention is to provide a yoga prop and method of use having advantages not taught by the prior art.

Another objective is to provide a yoga prop that may be used, individually or in sets, to assist a practitioner in achieving correct postures, and in improving and maintaining the postures.

A further objective is to provide a yoga prop that may also assist the practitioner in various stretches and other yoga exercises, performing the tasks of multiple other props, such as towels and straps.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a yoga prop for facilitating various yoga exercises and postures, for assisting a practitioner in assuming and holding various postures in more correct form, and for assisting the practitioner in various stretches and other movements.

Figure 1:
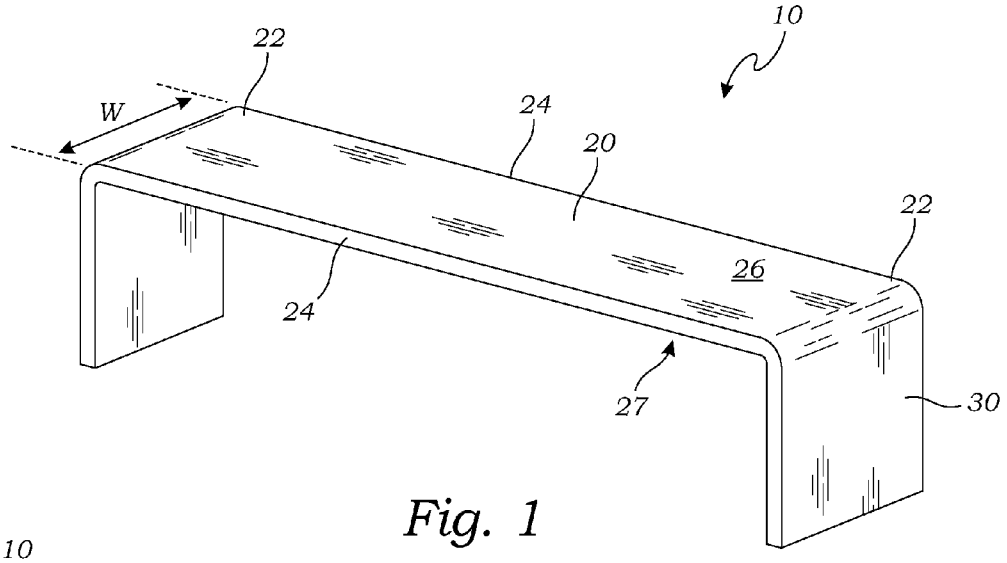
FIG. 1 is a perspective view of a yoga prop according to one embodiment of the present invention.
Figure 2:
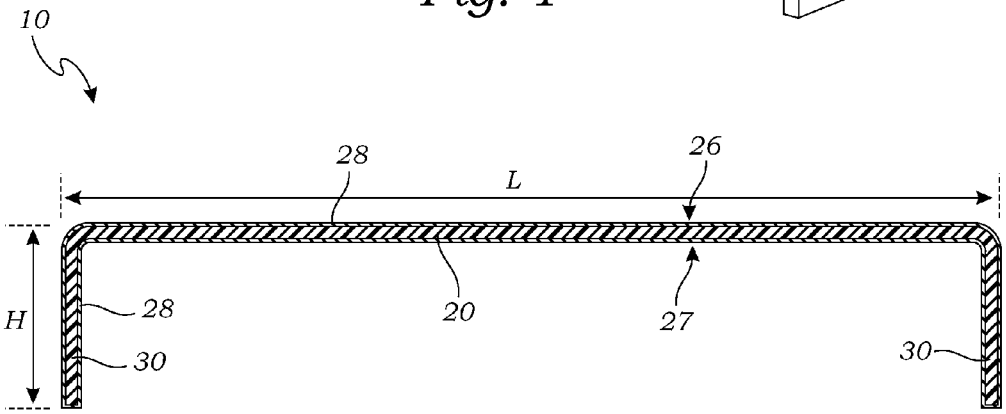
FIG. 2 is a side sectional view thereof taken along line 2-2 in FIG. 1.

FIG. 1 is a perspective view of the yoga prop according to one embodiment of the present invention. FIG. 2 is a side sectional view thereof taken along line 2-2 in FIG. 1. As shown in FIGS. 1-2, the yoga prop includes a rigid elongate plate with two ends, and end walls extending outwardly from each of the two ends of the elongate plate. The elongate plate may be in the form of a generally planar construction of a rigid material (e.g., aluminum, steel, or a suitable form of rigid plastic, or any other material deemed suitable by one skilled in the art). The elongate plate may have side edges, a top surface, and a bottom surface, that extend to the ends. In one embodiment, the elongate plate may be of a generally rectangular construction, although other shapes may also be used if desired. The elongate plate may have a preselected length, and a preselected width, that are suitable for the various postures, as discussed below.

In the current embodiment, the preselected length of the elongate plate may be in the range of about 12-18 inches, and the preselected width may be within the range of about 2-4 inches. The thickness of the elongate plate may vary, but is preferably less than ¼ of an inch, most preferably around 3-4 cm, to prevent interference with the postures. For purposes of this application, the term "about" is defined to mean +/−10%.

In one embodiment, the yoga prop is included in a prop set that includes a plurality of the yoga props of different sizes. In one embodiment, the prop set includes three or more of the yoga props (first, second, and third yoga props, illustrated in FIG. 3), having lengths of 12 inches, 14 inches, and 16 inches, (and potentially longer, e.g., 18, and 20 inches) for facilitating various postures.

As shown in FIGS. 1-2, the end walls are generally perpendicular to the elongate plate, and extend upwardly about 2.5-4 inches, preferably about 3 inches, so as to engage a practitioner's limbs without extending far enough to interfere with the posture. In one embodiment, the elongate plate and the end walls together form a generally U-shaped body. The elongate plate and the end walls may be formed from a single elongate plate of suitable material, which has been bent into the U-shape during fabrication. The U-shaped body may be substantially covered with a resilient coating to provide the yoga prop with a soft, rubbery feel.

Figure 3:
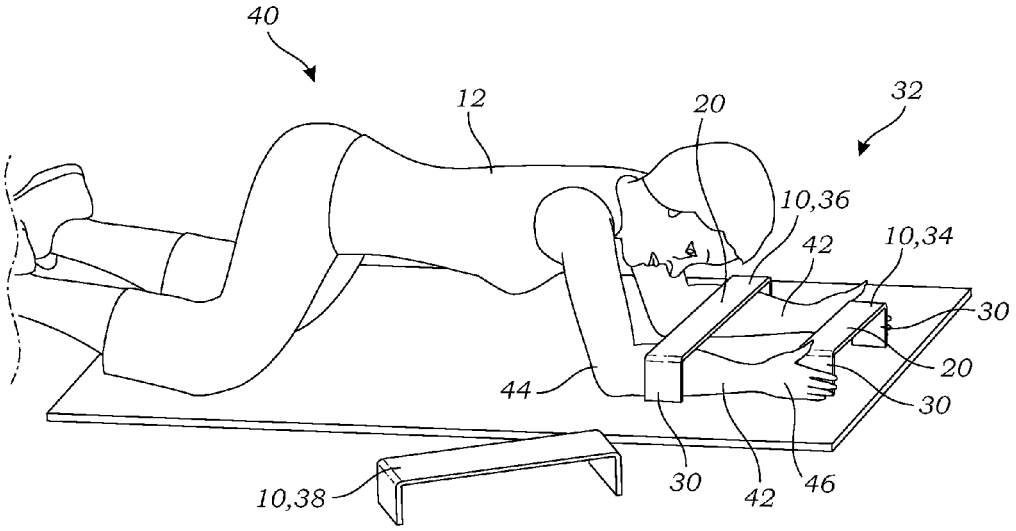
FIG. 3 is a perspective view of a practitioner performing a first yoga posture using two of the yoga props of FIG. 1 to correctly position the practitioner's arms in the first yoga posture.

FIG. 3 is a perspective view of a practitioner performing a first yoga posture using two of the yoga props of FIG. 1 to correctly position the practitioner's arms in the first yoga posture. As illustrated in FIG. 3, and as discussed above, the invention may include the prop set that includes a plurality of the yoga props, of different sizes, in this case a first yoga prop, a second yoga prop, and a third yoga prop. In this embodiment, the first yoga prop has an elongate plate that is about 12 inches long, the second yoga prop is about 14 inches long, and the third yoga prop is about 16 inches long. Obviously, various numbers of the yoga props may be used, and in any number of various shapes and sizes, according to the needs of the various practitioners. For example, men may use larger sizes, so a yoga kit for men might include 14 inch, 16 inch, and 18 inch models, and may further include a fourth (not shown) that is 20 inches.

As shown in FIG. 3, the yoga prop enables a novel method for performing yoga, in which the yoga prop is used to assist the practitioner in achieving a correct posture, and/or assist the practitioner with improving and maintaining the posture. The practitioner is first positioned in a yoga posture that includes positioning limbs 42, in this case the arms, the preselected length apart from each other. The yoga prop is then positioned adjacent the limbs 42 of the practitioner, typically between or around the limbs, such that the end walls abut the limbs 42 of the practitioner and hold the limbs the preselected length from each other.

As shown in FIG. 3, the practitioner is in a preparatory pose preparing for a dolphin posture or a forearm balance (sanskrit makarasana or pincha mayurasana). In this posture, it is important to keep one's elbows 44 in and the hands 46 out. As shown in FIG. 1, the first yoga prop is positioned between the practitioner's hands 46, so that the end walls prevent the practitioner's hands from moving towards each other.

In one embodiment, the second yoga prop may also be used to correctly position the elbows 44, although the use of two yoga props is not required, a single, or more than two may also be used. In the embodiment of FIG. 3, the second yoga prop is positioned over the practitioner's forearms, adjacent the elbow 44, such that the end walls hold the practitioner's elbows 44 in the correct position, and do not allow them to shift outwardly. Together, these two yoga props will maintain the practitioner's arms 42 in the correct configuration for these postures.

Figure 4:
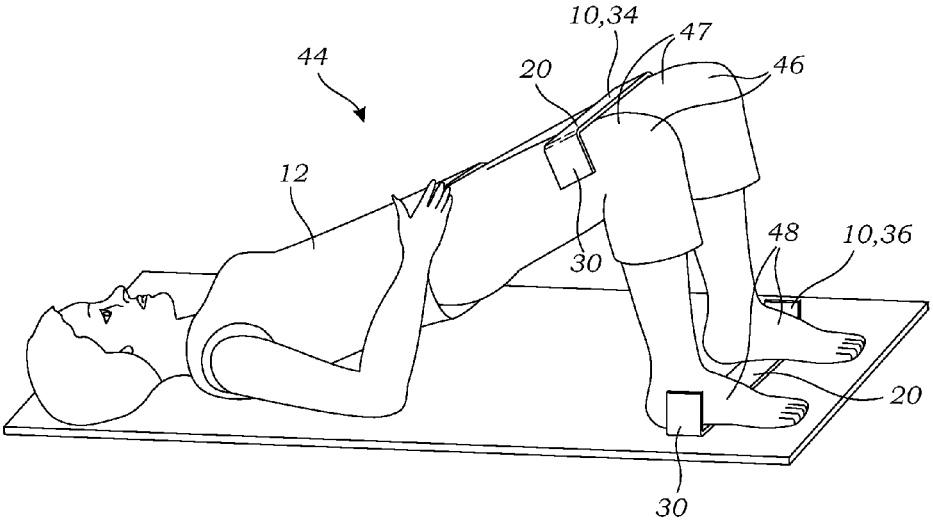
FIG. 4 is a perspective view of the practitioner performing a second yoga posture using two of the yoga props of FIG. 1 to correctly position the practitioner's legs in the second yoga posture.

FIG. 4 is a perspective view of the practitioner performing a second yoga posture using two of the yoga props of FIG. 1 to correctly position the practitioner's legs in the second yoga posture. This figure illustrates the practitioner in a bridge posture (setu bandha sarvangasana). As shown in FIG. 4, the first yoga prop is positioned adjacent the practitioner's limbs 46, in this case her legs. In this embodiment, the first yoga prop is positioned over the practitioner's thighs, adjacent the knees, so that the end walls prevent the practitioner's legs from moving outwardly. The second yoga prop is positioned under the practitioner's feet, such that the end walls hold the practitioner's feet in the correct position, and do not allow them to shift outwardly. Together, these two yoga props will maintain the practitioner's legs in the correct configuration for this posture.

In addition to helping the practitioner in maintaining correct form, the yoga prop may also be used for other purposes, such as stretching and otherwise manipulating the limbs of the practitioner.

Figure 5:
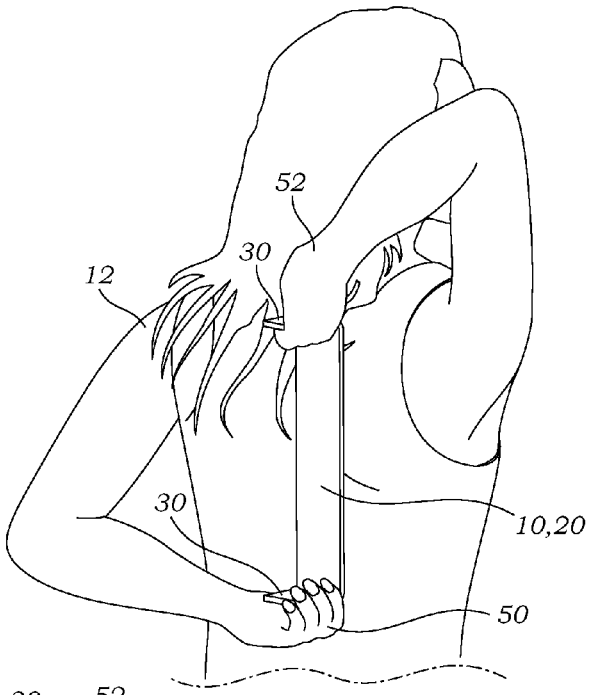
FIG. 5 is a perspective view of the practitioner stretching her arm using the yoga prop.
Figure 6:
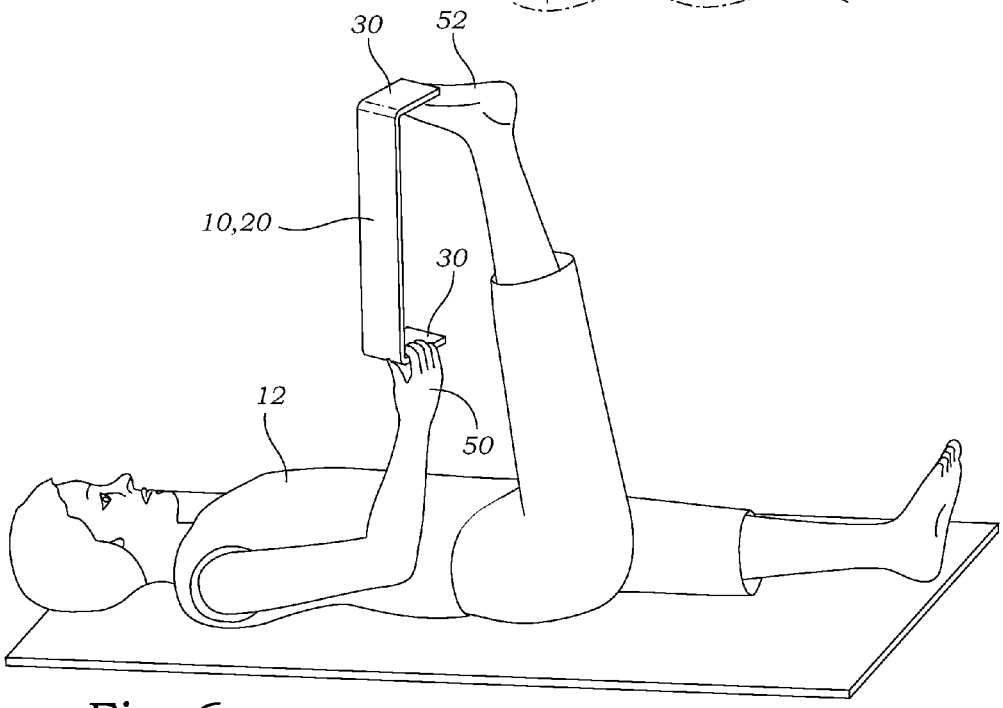
FIG. 6 is a perspective view of the practitioner stretching her leg using the yoga prop.

FIG. 5 is a perspective view of the practitioner stretching her arm using the yoga prop. FIG. 6 is a perspective view of the practitioner stretching her leg using the yoga prop. As shown in FIGS. 5-6, in another method for performing yoga, the yoga prop is used to stretch the limbs of the practitioner, the arms in FIG. 5, and the legs in 6. A first of the two ends of the yoga prop is engaged with a first limb of the practitioner, and a second of the two ends of the yoga prop is engaged with a second limb of the practitioner.

In FIG. 5, the first limb is an arm, and the second limb is the other arm. Then, the first limb (the first arm) is used to pull on the yoga prop, thereby stretching the second limb (the other arm). In FIG. 6, the first limb is the arm (or, potentially, both arms), and the second limb is a (e.g., the underside of the foot is engaged). When the practitioner pulls with his or her arm (s), the leg is stretched. These methods are currently performed using towels, straps, or other similar flexible props. The rigid nature of the current invention facilitates these stretches, especially leg stretches, and especially for less flexible practitioner ho may not be able to reach the strap around their foot to connect the flexible strap to their foot.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A method for performing yoga, the method comprising the steps of:

providing a yoga prop having a rigid elongate plate with two ends, and an end wall extending outwardly from each of the two ends of the elongate plate generally perpendicular to the elongate plate, the elongate plate having a preselected length;

positioning a practitioner in a yoga posture that includes positioning limbs the preselected length apart from each other; and positioning the yoga prop between the limbs of the practitioner such that the end walls abut the limbs of the practitioner and holds the limbs the preselected length from each other.

2. A method for performing yoga, the method comprising the steps of:

providing a yoga prop having a rigid elongate plate with two ends, and an end wall extending outwardly from each of the two ends of the elongate plate generally perpendicular to the elongate plate, the elongate plate having a preselected length;

engaging a first of the two ends of the yoga prop with a first limb of the practitioner;

engaging a second of the two ends of the yoga prop with a second length of the practitioner; and pulling with the first limb on the yoga prop, thereby stretching the second limb.

* * * * *